US007576698B2

(12) United States Patent
Cheng

(10) Patent No.: US 7,576,698 B2
(45) Date of Patent: Aug. 18, 2009

(54) DUAL-BAND ANTENNA

(75) Inventor: Pi-Hsi Cheng, Hsinchu County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 12/058,237

(22) Filed: Mar. 28, 2008

(65) Prior Publication Data

US 2009/0128416 A1 May 21, 2009

(30) Foreign Application Priority Data

Nov. 21, 2007 (TW) ..... 96144185 A

(51) Int. Cl.
*H01Q 1/24* (2006.01)

(52) U.S. Cl. ..... 343/700 MS; 343/846; 343/895

(58) Field of Classification Search ..... 343/700 MS, 343/846, 702, 829, 895
See application file for complete search history.

(56) References Cited

U.S. PATENT DOCUMENTS

| | | | | |
|---|---|---|---|---|
| 6,040,806 | A * | 3/2000 | Kushihi et al. | 343/853 |
| 6,515,626 | B2 * | 2/2003 | Bark et al. | 343/700 MS |
| 6,518,937 | B2 * | 2/2003 | Fang | 343/895 |
| 7,345,647 | B1 * | 3/2008 | Rodenbeck | 343/895 |
| 2008/0007478 | A1 * | 1/2008 | Jung et al. | 343/895 |
| 2008/0198089 | A1 * | 8/2008 | Hsiao et al. | 343/850 |

* cited by examiner

*Primary Examiner*—Tho G Phan
(74) *Attorney, Agent, or Firm*—Birch, Stewart, Kolasch & Birch, LLP

(57) ABSTRACT

A dual-band antenna includes a first radiating unit, a second radiating unit, a micro-line unit and a grounding unit. The first radiating unit has a zigzag portion. The second radiating unit is connected with the first radiating unit and has a gap. The micro-line unit includes a first terminal, a second terminal and a feeding point. The first terminal is respectively connected with the first radiating unit and the second radiating unit. An acute angle is formed between the first radiating unit and the micro-line unit. The grounding unit is connected with the second terminal of the micro-line unit and has a grounding point.

9 Claims, 4 Drawing Sheets

DUAL-BAND ANTENNA

CROSS REFERENCE TO RELATED APPLICATIONS

This Non-provisional application claims priority under 35 U.S.C. §119(a) on Patent Application No(s). 096144185 filed in Taiwan, Republic of China on Nov. 21, 2007, the entire contents of which are hereby incorporated by reference.

BACKGROUND OF THE INVENTION

1. Field of Invention

The invention relates to an antenna and, in particular, to a dual-band antenna.

2. Related Art

The prosperous development in wireless transmission has brought us various kinds of multi-frequency transmission products and technologies. Many new products are built in with the function of wireless transmissions. The antenna is an important element in a wireless transmission system to emit and receive electromagnetic (EM) wave energy. Without the antenna, the wireless transmission system will not be able to emit and receive data. Therefore, the antenna is indispensable for wireless transmissions. Besides fitting to the product shape and enhancing transmissions, using an appropriate antenna can further reduce the product cost.

Commonly used standards of the bandwidths include IEEE 802.11 and the hottest Bluetooth communications (802.15.1). The Bluetooth technology works in the 2.4 GHz band. The 802.11 standard is further divided into 802.11a, 802.11b, 502.11g and 802.11n, defined for the 5 GHz band and the 2.4 GHz band, respectively.

The wireless LAN apparatuses, such as the wireless network card and the access point, can sufficiently simplify the set-up of the network hardware. In addition, since the wireless LAN apparatuses are portable, they become more convenient. In order to enhance-the transmission ability, the wireless LAN apparatus is usually equipped with dual-band or multi-band transmission function, so that it can switch between different modes for receiving or transmitting desired data.

However, it is time consumption to design antennas with different bands, and the antennas with different bands may occupy large area or space. Accordingly, the dual-band antenna, which can operate in two different bands, is developed. In addition, since the electronic devices are manufactured smaller, the size of the antennas is also requested to be decreased. Therefore, it is an important subject to decrease the size of the antenna.

SUMMARY OF THE INVENTION

In view of the foregoing, the invention is to provide a dual-band antenna with a decreased size.

To achieve the above, the invention discloses a dual-band antenna including a first radiating unit, a second radiating unit, a micro-line unit and a grounding unit. The first radiating unit has a zigzag portion. The second radiating unit is connected with the first radiating unit and has a gap. The micro-line unit has a first terminal, a second terminal and a feeding point. The first terminal is connected to the first radiating unit and the second radiating unit, respectively. An acute angle is formed between the first radiating unit and the micro-line unit. The impedance matching of the dual-band antenna can be tuned by adjusting the location of the feeding point on the micro-line unit. The grounding unit is connected with the second terminal of the micro-line unit and has a grounding point. The configuration of the first and second radiating units can achieve the dual-band function.

As mentioned above, the zigzag portion of the first radiating unit and the gap of the second radiating unit can help to fit the current path length for the wireless LAN band requirement. Thus, the areas of the first and second radiating units can be reduces, thereby decreasing the whole area of the dual-band antenna.

Moreover, since the first radiating unit and the microline unit form an acute angle, a close-like resonance chamber can be formed. In other words, the adjustment range of the feeding point on the micro-line unit is wider so as to achieve optimum impedance matching.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
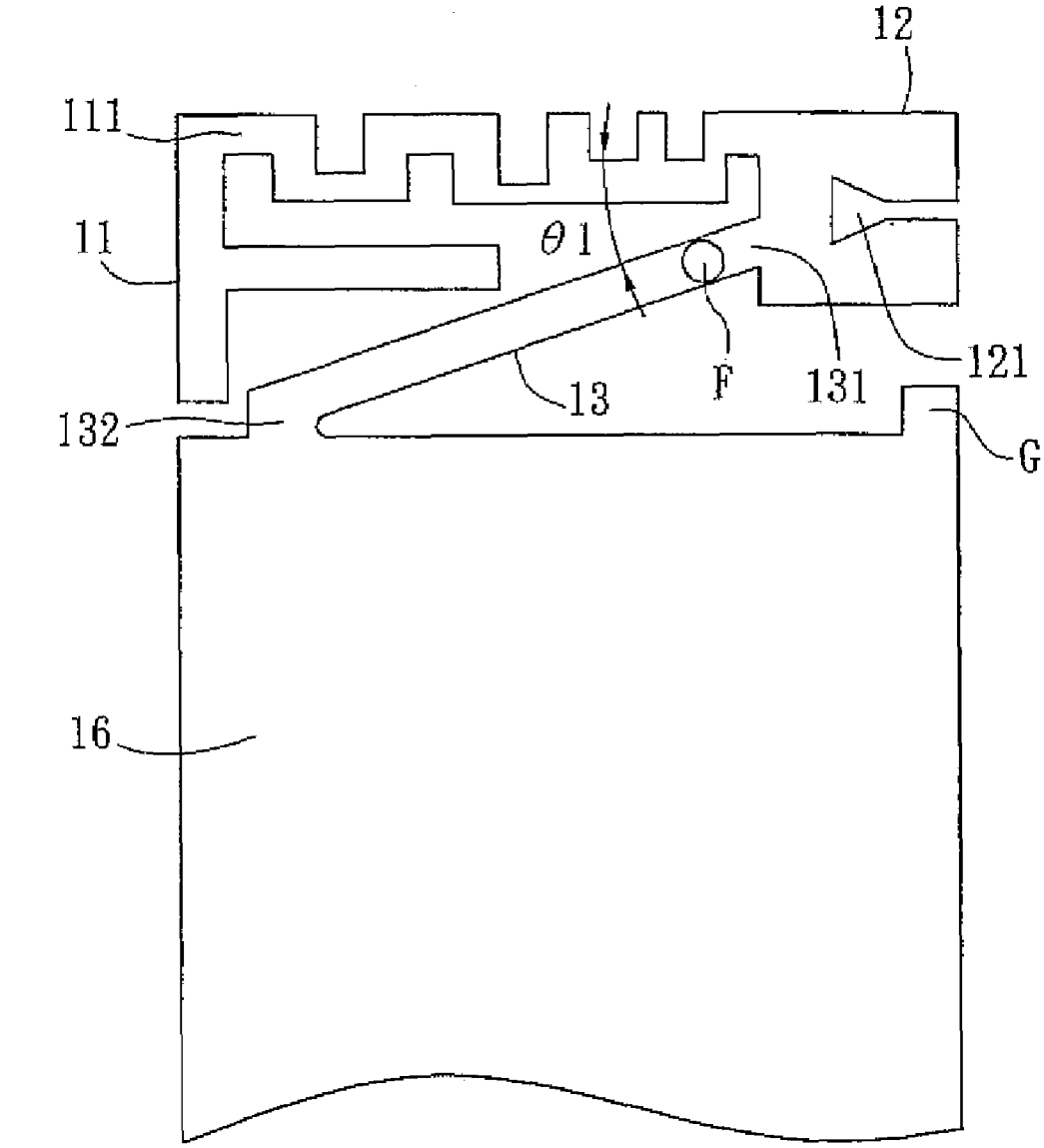
FIG. 1 is a schematic illustration showing a dual-band antenna according to a preferred embodiment of the invention.

With reference to FIG. 1, a dual-band antenna 1 according to a preferred embodiment of the invention includes a first radiating unit 11, a second radiating unit 12, a micro-line unit 13 and a grounding unit 16.

The first radiating unit 11 has a zigzag portion 111 and is connected with the second radiating unit 12. The second radiating unit 12 has a gap 121. In the embodiment, the second radiating unit 12 can be polygonal or circular, and the gap 121 can be triangular-like, circular or rectangular. Thus, the area of the second radiating unit 12 can decreased, and the resonant frequency thereof can be increased. In the following description, the second radiating unit 12 is rectangular and the gap 121 is triangular-like, for example.

The micro-line unit 13 has a first terminal 131, a second terminal 132 and a feeding point F. In the embodiment, the first terminal 131 is connected to the first radiating unit 11 and the second radiating unit 12, respectively, and the second terminal 132 is connected to the grounding unit 16. The grounding unit 16 has a grounding point G, which can be disposed on any position of the grounding unit 16.

An acute angle θ1, which is smaller than 90 degrees, is formed between the first radiating unit 11 and the micro-line unit 13. Therefore, the length of the micro-line unit 13 of the embodiment is longer than that of the case of a right angle, so that the adjusting range of the position of the feeding point F on the micro-line unit 13 can be increased. Accordingly, the optimum impedance matching can be obtained.

In the embodiment, a triangular-like resonance chamber is formed between the first radiating unit 11 and the micro-line unit 13, so that one of the dual bands of the dual-band antenna 1 can be obtained.

Figure 2:
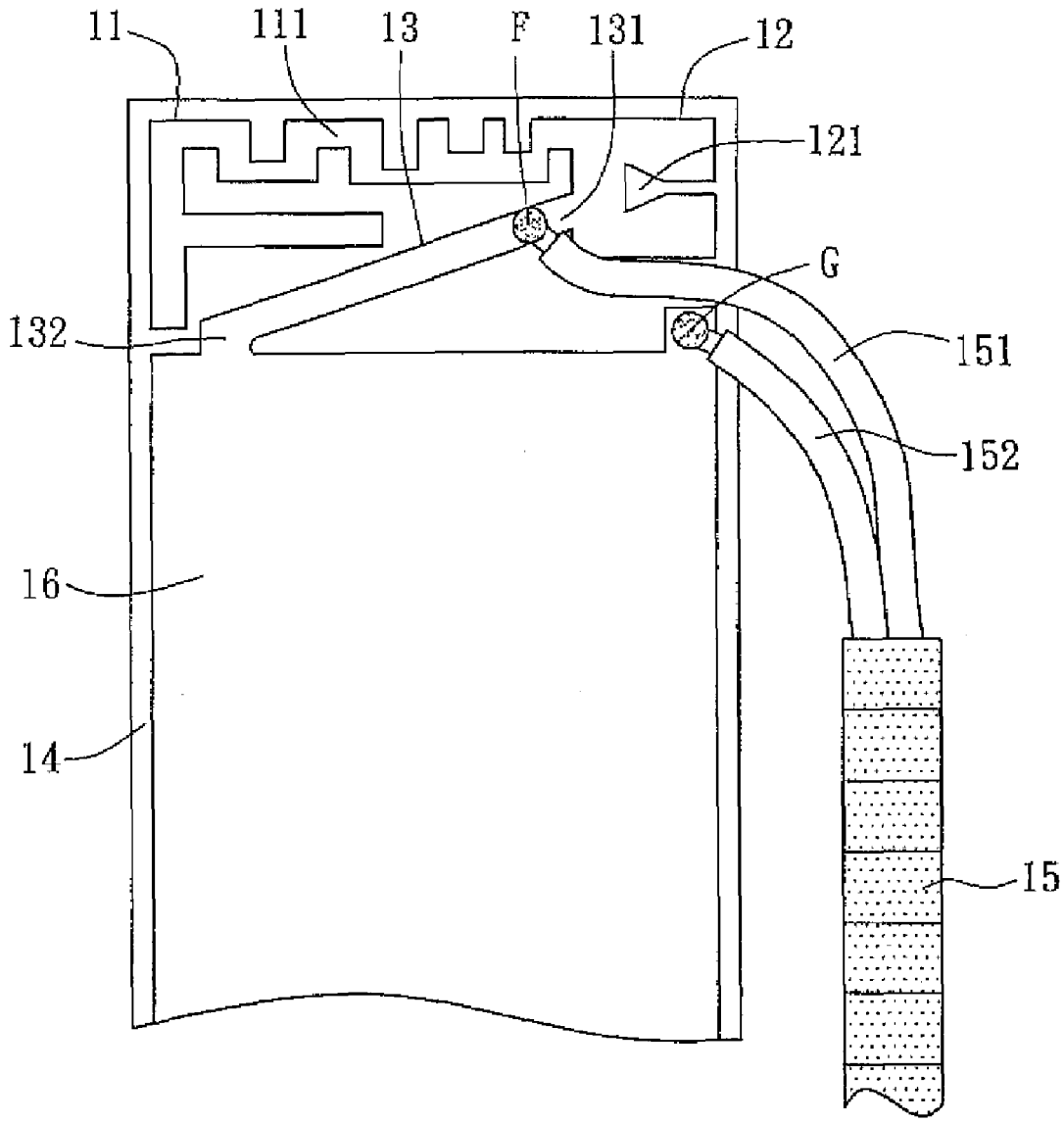
FIG. 2 is a schematic illustration showing the dual-band antenna according to the preferred embodiment of the invention that is disposed on a substrate.

With reference to FIG. 2, the first radiating unit 117 the second radiating unit 12, the micro-line unit 13 and the grounding unit 16 of the embodiment can be integrally formed. In the embodiment, the first radiating unit 11, the second radiating unit 12, the micro-line unit 13 and the grounding unit 16 can be manufactured by a conductive thin plate or metal thin plate. Alternatively, they can also be disposed on a substrate 14 by way of printing or etching. The substrate 14 can be a printed circuit board (PCB) made of bismaleimide (BT) resin or fiberglass reinforced epoxy resin (FR4). Of course, the substrate 14 can also be a flexible film substrate made of polyimide. Moreover, the first radiating unit 11, the second radiating unit 12, the micro-line unit 13 and the grounding unit 16 can be integrated in the whole circuit so as to reduce the occupied space of the dual-band antenna 1.

In addition, the dual-band antenna 1 may farther include a conductive unit 15, which has a conductive portion 151 and a grounding portion 152. The conductive portion 151 is electrically connected to the feeding point F, and the grounding portion 152 is electrically connected to the grounding point G. In the embodiment, the conductive unit 15 can be coaxial cable having a central wire as the conductive portion 151 and a grounding wire as the grounding portion 152. To be noted, the connection between the conductive unit 15 and the dual-band antenna 1 can be various depending on the product shape, and the only requirement is that the conductive portion 151 and the grounding portion 152 must be electrically connected with the feeding point F and the grounding point G, respectively.

Figure 3A:
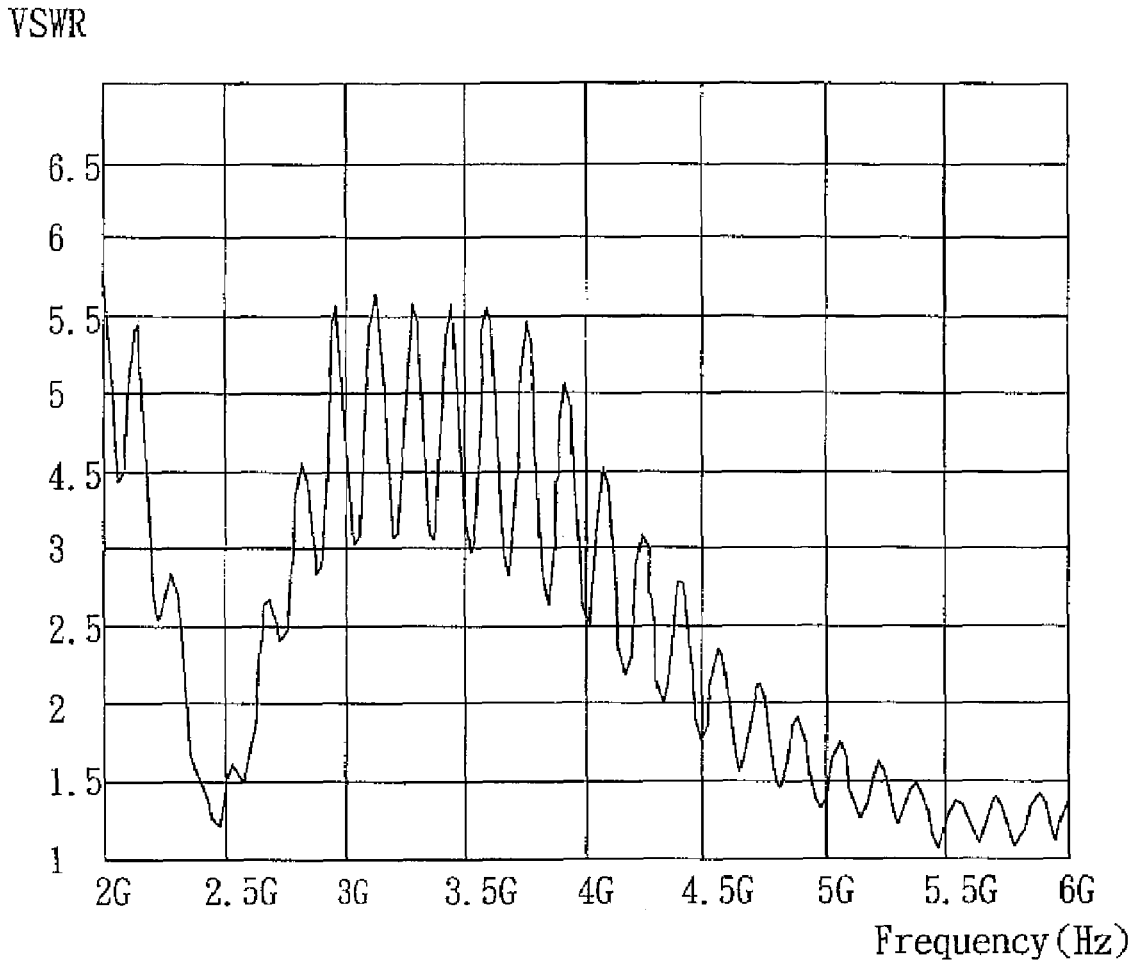
FIGS. 3A to 3B are schematic illustrations showing the measuring result of the operating band of the dual-band antenna according to the preferred embodiment of the invention.
Figure 3B:
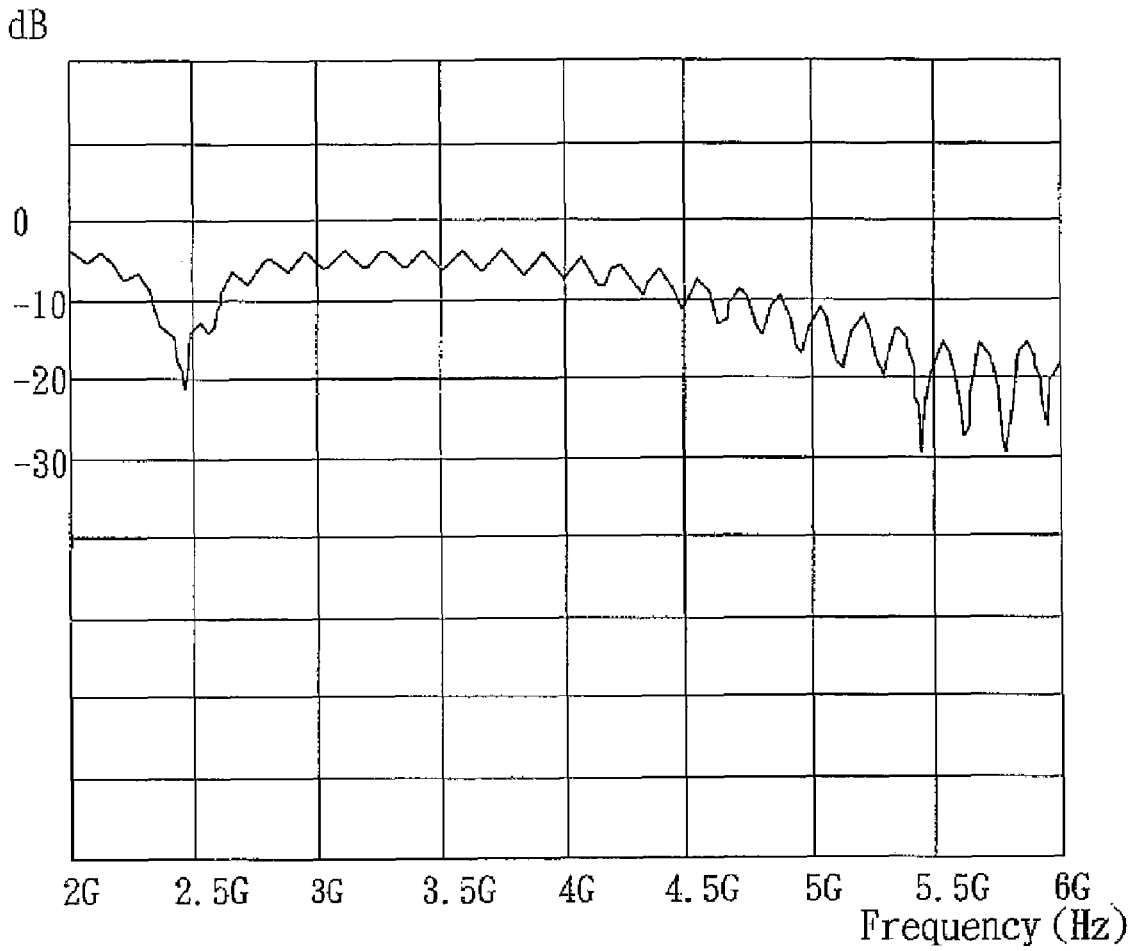

Referring to FIG. 3A, the vertical coordinate represents the voltage standing-wave ratio (VSWR), and the horizontal coordinate represents the frequency. Under the definition of operating range with VSWR lower than 2, the operating range of the first radiating unit 11 is between 2.3 GHz and 2.6 GHz, and the operating range of the second radiating unit 12 is between 4.9 GHz and 6.0 GHz. Referring to FIG. 3B showing the return loss, the vertical coordinate represents the intensity (dB), and the horizontal coordinate represents the frequency. With the base line of −10 dB, the operating range of the first radiating unit 11 is between 2.3 GHz and 2.6 GHz, and the operating range of the second radiating unit 12 is between 4.9 GHz and 6.0 GHz.

In summary, the dual-band antenna of the invention has the first and second radiating units to achieve the dual-band function. The zigzag portion of the first radiating unit and the gap of the second radiating unit can help to fit the current path length for the wireless LAN band requirement. Thus, the whole area of the dual-band antenna can be decreased. Moreover, since the first radiating unit and the micro-line unit form an acute angle, a close-like resonance chamber can be formed. Therefore, the adjustment range of the feeding point on the micro-line unit is wider so as to achieve optimum impedance matching.

Although the invention has been described with reference to specific embodiments, this description is not meant to be construed in a limiting sense. Various modifications of the disclosed -embodiments, as well as alternative embodiments, will be apparent to persons skilled in the art. It is, therefore, contemplated that the appended claims will cover all modifications that fall within the true scope of the invention.

What is claimed is:

1. A dual-band antenna, comprising:

a first radiating unit having a zigzag portion;

a second radiating unit connected with the first radiating unit and having a gap;

a micro-line unit having a first terminal, a second terminal and a feeding point, wherein the first terminal is connected to the first radiating unit and the second radiating unit, respectively, and an acute angle is formed between the first radiating unit and the micro-line unit; and a grounding unit connected with the second terminal of the micro-line unit and having a grounding point.

2. The antenna according to claim 1, wherein a resonance chamber is formed between the first radiating unit and the micro-line unit.

3. The antenna according to claim 1, wherein the second radiating unit is polygonal or circular.

4. The antenna according to claim 1, wherein the gap is triangular-like, circular or rectangular.

5. The antenna according to claim 1, further comprising:

a conductive unit having a conductive portion and a grounding portion, wherein the conductive portion is electrically connected to the feeding point, and the grounding portion is electrically connected to the grounding point.

6. The antenna according to claim 1, further comprising a substrate, wherein the first radiating unit, the second radiating unit and the micro-line unit are disposed on a surface of the substrate.

7. The antenna according to claim 6, wherein the substrate is a printed circuit board (PCB).

8. The antenna according to claim 1, wherein the first radiating unit, the second radiating unit and the micro-line unit are integrally formed.

9. The antenna according to claim 1, wherein an operation frequency of the second radiating unit is higher than an operation frequency of the first radiating unit.

* * * * *